United States Patent [19]

Palka

[11] 4,057,028

[45] Nov. 8, 1977

[54] OUTBOARD MOTOR PROPELLER GUARD

[76] Inventor: Mike F. Palka, 7651 S. Wolf Road, LaGrange, Ill. 60525

[21] Appl. No.: 738,316

[22] Filed: Nov. 2, 1976

[51] Int. Cl.[2] ..... B63H 5/16

[52] U.S. Cl. ..... 115/42

[58] Field of Search ..... 114/145 R, 145 A; 115/17, 18 R, 34 R, 40, 41 R, 42

[56] References Cited

U.S. PATENT DOCUMENTS

| | | | |
|---|---|---|---|
| 1,524,857 | 2/1925 | Evinrude | 115/18 R |
| 1,990,387 | 2/1935 | Linthwaite | 115/41 R |

*Primary Examiner*—George E. A. Halvosa
*Assistant Examiner*—Jesus D. Sotelo
*Attorney, Agent, or Firm*—Richard E. Nanfeldt; Ralph J. Skinkiss

[57] ABSTRACT

A resilient "C" shaped propeller guard, pivotally attached to the propeller housing below the propeller and linked to a movable semi-rigid cable at its other end, transmits impact forces upon the guard through the cable thereby shifting the output of an outboard motor to the neutral position when the guard encounters propeller damaging objects.

2 Claims, 2 Drawing Figures

OUTBOARD MOTOR PROPELLER GUARD

BACKGROUND OF THE INVENTION

Various types of outboard motor and out drive propeller guard assemblies have been heretofore designed, however, the majority of these propeller guards have been of the type whereby when the guard encounters a potentially damaging body, either floating or submerged, it acts solely to deflect the body from direct contact with the propeller, with no provision for alleviating the condition. Examples of previously patented propeller guards of this nature are disclosed in U.S. Pat. Nos. 2,706,960; 2,717,570; 2,972,977 and 2,682,854.

BRIEF DESCRIPTION OF THE INVENTION

The outboard motor propeller guard of the present invention includes a resilient "C" shaped delfector bar constructed in solid or hollow configuration preferably of a suitable impact resistant plastic with coupling means affixed to the upper and lower ends. A pivotal mount is provided on the propeller housing beneath the propeller for pivotal attachment of the lower end of the guard bar to the propeller housing. A sheath member is included, mounted to the gearing housing above and behind the propeller, to slidably retain the upper end of the guard bar as the bar pivots about the pivotal mount. A flexible cable and suitable sheath is included for the operational linkage of the upper end of the guard bar with the motor's transmission control lever located inside the boat.

The main object of this invention is to provide a resilient propeller guard bar for an outboard motor constructed in a manner whereby upon forcefull contact with a potentially damaging body, either floating or submerged, the outboard motor will instantly be shifted to the neutral output position thus reducing the potential damage to the propeller and motor.

Another object of this invention is to provide a resilient propeller guard bar constructed in a manner whereby upon forcefull contact with a potentially damaging body the propeller guard bar will not shatter but will direct a portion of the force upward to the sheath mounted preferably on the propeller shaft housing.

A final object of this invention to specifically enumerated herein is to provide a propeller guard in accordance with the preceding objects and which will conform to conventional forms of manufacture, be of simple construction and easy to install so as to provide a device that will be economically feasible, long lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
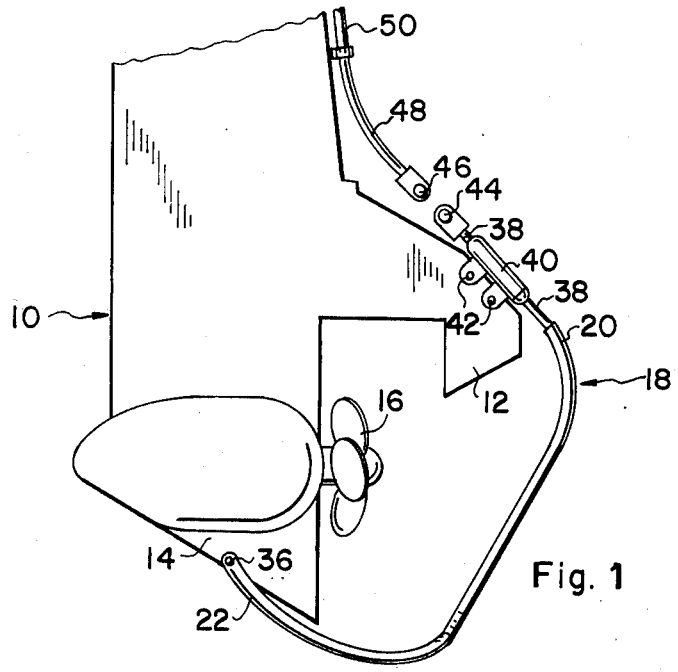
FIG. 1 illustrates a side view of the propeller guard assembly in position on the propeller shaft housing with the flexible cable linkage shown extending upwardly to the interior of the boat.
Figure 2:
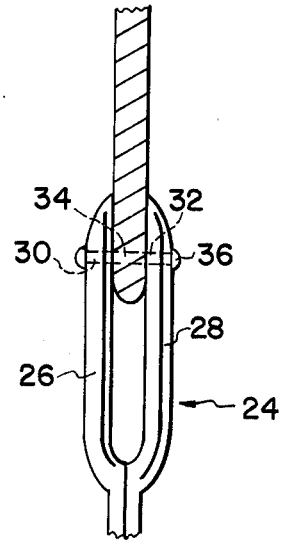
FIG. 2 illustrates a front view of the pivotal mount liking the propeller guard bar to the propeller housing.

Referring now more specifically to the drawings, the numeral 10 generally designates the propeller shaft and gearing housing of a conventional outboard motor having a vertical fin or skeg 12 and a lower propeller housing 14 and propeller 16.

The propeller guard bar of the present invention is referred to in general by the reference numeral 18 and includes an upper end 20 and lower end 22. The lower end 22 of guard bar 18 is affixed to a forked fastening member generally referred to by reference numeral 24 including side arms 26 and 28 adapted for positioning on either side of lower propeller housing 14. Both side arms 26 and 28 are provided with a horizontally disposed hole therethrough 30 and 32, similarly the lower propeller housing 14 is provided with a horizontally disposed hole 34 therethrough. A pivot pin 36 is further provided to pass through hole 34 in the lower propeller housing 14 and fasten at one end to side arm 26 and at the other end 28.

The "C" shaped, vertically disposed guard bar 18 is affixed at its upper end 20 to a rigid rod 38 of smaller diameter. Support sheath 40 is provided to slidably retain rod 38 therethrough and includes means 42 for securely fastening sheath 40 to skeg 12. Rod 38 extends upwardly from sheath 40 and is provided with coupling 44 for attachment to a mating coupling 46 affixed to one end 48 of flexible cable 50. Flexible cable 50 is of conventional design and extends upwardly within a sheath (not shown) to the transmission control lever (not shown).

In operation, the lower end 22 of guard bar 18 pivots counterclockwise upon forcefull contact with a potentially damaging body deflecting the body away from propeller 16. As the lower end 22 pivots counterclockwise the "C" shaped guard bar 18 is forced upward thus urging rigid rod 38 through sheath 40. The upward displacement of rod 38 similarly urges cable 50 upward thus shifting the outboard motor into a neutral output position reducing possible damage to the propeller 16 from continued operation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A guard for outboard motors having propellers, propeller housings and a trailing skeg conprising:

a. "C" shaped resilient propeller guard bar having a first and a second end;

b. means for pivotally attaching said second end of the guard bar to the propeller housing at a point below said propeller;

c. an upwardly extending semi-rigid cable slidably contained within a semi-rigid sheath affixed to said skeg, one end of said cable in communication with the transmission control for said outboard motor;

d. means for connecting the second end of said semi-rigid cable to the first end of said guard bar such that pivotal movement of the guard bar induces translational movement of said cable within said sheath providing control of said motor transmission thereby.

2. The configuration of claim 1, wherein said means for connecting the second end of said semi-rigid cable to the first end of said guard bar comprises:

a. a rigid rod member affixed to the first end of said propeller guard; and b. a sheath to slidably retain said rigid rod member therein affixed to said skeg.

* * * * *